US008228149B2

(12) United States Patent
Puth et al.

(10) Patent No.: US 8,228,149 B2
(45) Date of Patent: Jul. 24, 2012

(54) ELECTROMAGNETIC ACTUATING MECHANISM

(75) Inventors: Thomas Puth, Friedrichshafen (DE); Reiner Keller, Ludwigshafen (DE); Michael Pantke, Friedrichshafen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 12/864,892

(22) PCT Filed: Feb. 11, 2009

(86) PCT No.: PCT/EP2009/051535

§ 371 (c)(1),
(2), (4) Date: Jul. 28, 2010

(87) PCT Pub. No.: WO2009/109444

PCT Pub. Date: Sep. 11, 2009

(65) Prior Publication Data

US 2011/0001591 A1 Jan. 6, 2011

(30) Foreign Application Priority Data

Mar. 6, 2008 (DE) ..... 10 2008 000 534

(51) Int. Cl.
*H01F 7/00* (2006.01)
*H01F 7/08* (2006.01)
*H01F 3/00* (2006.01)

(52) U.S. Cl. ..... 335/229; 335/220; 335/230; 335/234; 335/253; 335/255; 335/256; 335/261; 335/266; 335/268; 335/279

(58) Field of Classification Search ..... 335/241, 335/253–256, 266, 268, 282, 299, 219, 220, 335/222, 225, 228–230, 234, 261, 272, 279
See application file for complete search history.

(56) References Cited

U.S. PATENT DOCUMENTS

| | | | | |
|---|---|---|---|---|
| 3,070,730 | A * | 12/1962 | Gray et al. | 335/229 |
| 3,202,886 | A * | 8/1965 | Kramer | 335/234 |
| 3,504,320 | A * | 3/1970 | Engdahl et al. | 336/110 |
| 4,422,060 | A | 12/1983 | Matsumoto et al. | |
| 4,494,098 | A | 1/1985 | Haneda et al. | |
| 4,533,890 | A * | 8/1985 | Patel | 335/234 |
| 4,829,947 | A | 5/1989 | Lequesne | |
| 4,870,306 | A * | 9/1989 | Petersen | 310/12.31 |
| 4,928,028 | A * | 5/1990 | Leibovich | 310/23 |
| 5,434,549 | A * | 7/1995 | Hirabayashi et al. | 335/229 |
| 5,820,104 | A * | 10/1998 | Koyano et al. | 251/326 |
| 5,896,076 | A * | 4/1999 | van Namen | 335/229 |
| 5,947,155 | A * | 9/1999 | Miki et al. | 137/625.65 |
| 6,472,968 | B1 * | 10/2002 | Ohya | 335/229 |
| 6,983,923 | B2 * | 1/2006 | Fukui et al. | 251/65 |

(Continued)

FOREIGN PATENT DOCUMENTS

DE 1 892 313 5/1964

(Continued)

*Primary Examiner* — Mohamad Musleh
(74) *Attorney, Agent, or Firm* — Davis & Bujold, P.L.L.C.

(57) ABSTRACT

An electromagnetic control mechanism (1) with an actuating element (15) which can move longitudinally and can be retained in three stable positions. By way of two coils (3, 4), the actuating element (15) can be switched to a first or to a second stable position, namely, the two opposed end positions. The actuating element (15) comprises an actuator rod (7) with a permanent magnet (8) arranged on the actuator rod (7), such that the actuating element (15) can be retained magnetically in the third stable position by the permanent magnet (8).

8 Claims, 2 Drawing Sheets

U.S. PATENT DOCUMENTS

| | | | | |
|---|---|---|---|---|
| 7,347,221 | B2 | 3/2008 | Berger et al. | |
| 7,482,902 | B2 * | 1/2009 | Kampf et al. | 335/229 |
| 2005/0046531 | A1 * | 3/2005 | Moyer et al. | 335/256 |
| 2006/0130785 | A1 * | 6/2006 | Han et al. | 123/90.11 |
| 2008/0290972 | A1 * | 11/2008 | Jotter et al. | 335/229 |

FOREIGN PATENT DOCUMENTS

| | | | |
|---|---|---|---|
| DE | 34 00 264 | A1 | 7/1984 |
| DE | 34 02 768 | A1 | 8/1985 |
| DE | 44 00 433 | A1 | 7/1995 |
| DE | 102 07 828 | A1 | 9/2003 |
| DE | 103 10 448 | A1 | 9/2003 |
| DE | 10 2004 004 708 | B3 | 4/2005 |
| GB | 258 725 | | 9/1926 |
| GB | 2 052 886 | A | 1/1981 |
| GB | 2 104 730 | A | 3/1983 |

* cited by examiner

ELECTROMAGNETIC ACTUATING MECHANISM

This application is a National Stage completion of PCT/EP2009/051535 filed Feb. 11, 2009, which claims priority from German patent application serial no. 10 2008 000 534.7 filed Mar. 6, 2008.

FIELD OF THE INVENTION

The invention concerns an electromagnetic control mechanism.

BACKGROUND OF THE INVENTION

Electromagnetic control devices, also referred to as actors or actuators, control motors or displacement magnets, are widely known in control technology. For example, they serve to drive or actuate control valves or flap gates for controlling the through-flow of gaseous or liquid media. Most electromagnetic actuators are bistable, i.e. they have only two stable positions, for example 'on' or 'off'.

From DE 103 10 448 A1 a bistable actuator is known, which comprises two coils and an armature formed as a permanent magnet arranged on an armature rod. The polarity of the permanent magnet is orientated along the displacement direction of the armature, and the permanent magnet is held by the coils either in one or the other of its end positions. The coil configuration in this case forms a two-pole system, whereby the permanent magnet is attracted by one coil and at the same time repelled by the other coil, and vice-versa. This shortens the switching time.

From DE 102 07 828 A1 a bistable electromagnetic displacement magnet is known, whose polarity is orientated radially, i.e. transversely to the movement direction of the armature.

Besides bistable actuators, tristable actuators are also known: from DE 1 892 313 U a displacement electromagnet with three stable positions, namely two outer end positions and a central position, is known. The displacement electromagnet comprises a total of four coils, two stationary permanent magnets, two outer housing-antipoles, two inner housing-antipoles and two armatures that can move longitudinally on a push-rod. In each case an end position is reached by energizing an outer coil, the armatures being attracted by the energized coil. In contrast, the central position of the push-rod is reached when the armatures are held by the permanent magnets, which are in contact on both sides against the inner housing-antipoles (partition wall). The disadvantage of this known displacement electromagnet are that it comprises a large number of parts, namely four coils, two permanent magnets and two armatures, which also make for substantial extra weight.

SUMMARY OF THE INVENTION

The purpose of the present invention is to provide an inexpensive electromagnetic control mechanism of the type mentioned at the start, which is of simple design and comprises a smaller number of individual components.

According to the invention, it is provided that the actuating element consists of an actuator rod with a permanent magnet arranged on it, and in its third stable position the actuating element can be held by the magnetic flux of the permanent magnet. This gives the advantages that the central position is maintained without the coils having to be energized, and that fewer parts are involved.

In an advantageous design the two coils are respectively arranged at the ends of a pole tube, i.e. a tube made from magnetic material, and each coil has a yoke, preferably made from a ferromagnetic material. In this way the magnetic flux passes through the yoke and the pole tube, so that depending on the way the coils are energized different polarities can be produced.

In a further advantageous design the actuator rod is arranged coaxially with the pole tube and is mounted so that it can slide within openings of the yokes. Associated with the permanent magnet is a preferably annular holding pole, which is preferably arranged inside the pole tube approximately in the middle thereof between the two coils. The holding pole is made from a magnetic material and in the third stable position, i.e. the central position of the armature, the magnetic flux of the permanent magnet passes through it. Owing to the closed magnetic circuit between the holding pole and the permanent magnet, the actuating element is held in place magnetically without having to energize the coils.

To strengthen the magnetic flux of the permanent magnet, flux plates can be attached on the end faces of the permanent magnet. It is also advantageous to apply anti-adhesion disks on the flux plates, which prevent the permanent magnet from sticking to the coil yokes.

In another advantageous design, plunger-type armatures preferably of conical shape are provided on the end faces of the permanent magnet, which project into corresponding openings in the coil yokes. This increases the magnetic attraction force exerted by the coils on the actuating element.

In a further advantageous design, the polarity of the permanent magnet is orientated along the displacement direction of the actuating element and the actuator rod. Thus, a north pole is formed on one end face of the permanent magnet and a south pole on its opposite end face. Thus, depending on the manner in which the coils are energized, a force of attraction and/or a force of repulsion can be exerted on the permanent magnet so that it is pushed to one or the other end position.

In a further advantageous design an additional coil, a so-termed central coil, can be arranged in the area of the holding pole, which, when it is appropriately energized, cancels the retaining action of the permanent magnet in its central position and so allows more rapid movement of the actuating element to one or other of its end positions. This improves the dynamic response of the actuator.

BRIEF DESCRIPTION OF THE DRAWINGS

An example embodiment of the invention is illustrated in the drawing and will be described in more detail below. The drawings show.

DETAILED DESCRIPTION OF THE PREFERRED EMBODIMENTS

Figure 1:
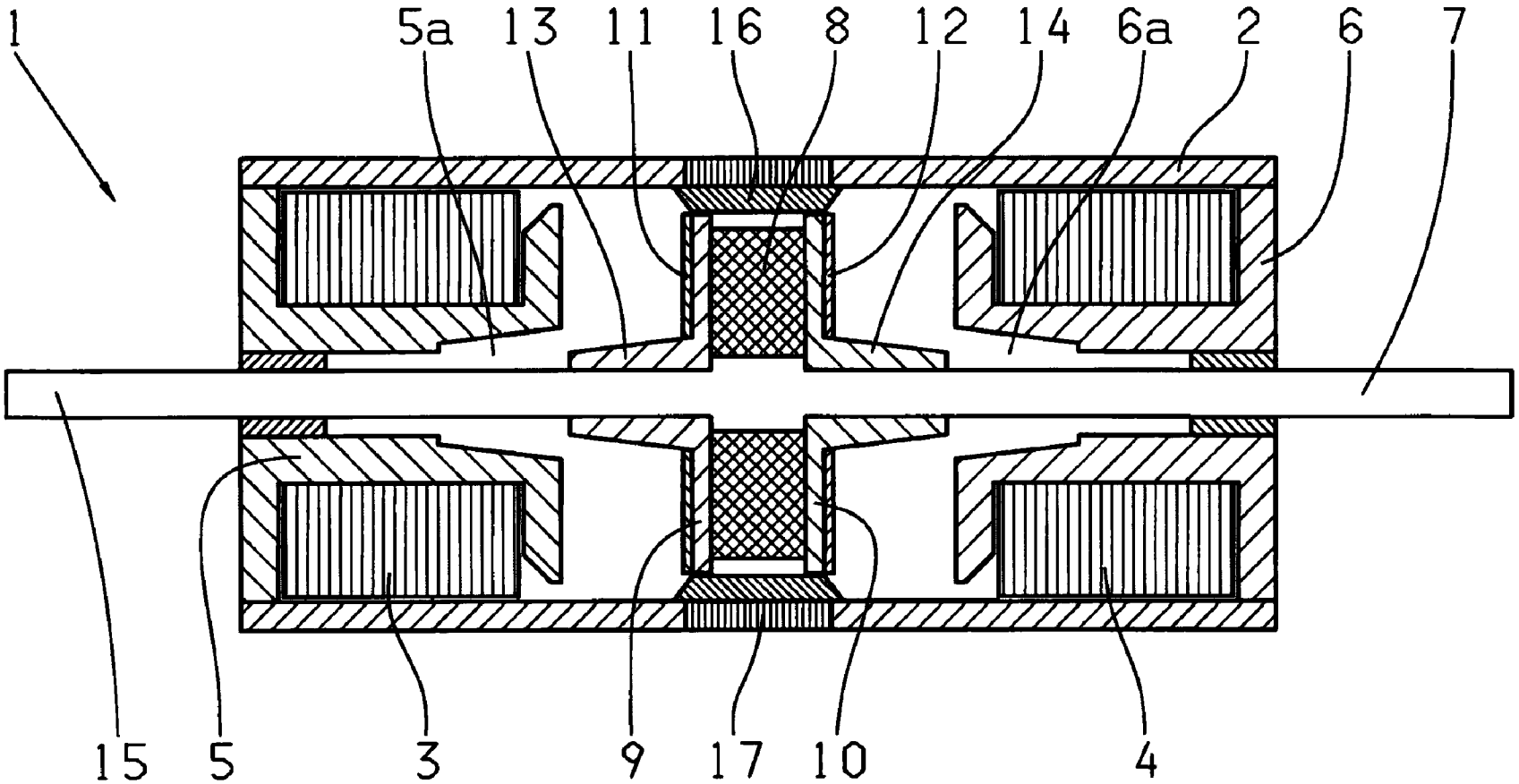
FIG. 1: Cross-section through an electromagnetic control mechanism according to the invention.

FIG. 1 shows an electromagnetic control mechanism 1, which could also be called an electrodynamic actuator or actor. The actuator 1 comprises a cylindrical magnetic pole tube 2 in which, at its ends, are arranged two coils 3, 4, each having a respective yoke 5 and 6. The coils 3, 4 are connected to a current supply (not shown) and can be energized in different current flow directions, so that opposite polarities can be produced. Coaxially with the pole tube is arranged an actuator rod 7, also called the armature rod, which is fitted so that it can move longitudinally and slide in the two yokes 5, 6. Approximately in the middle of the actuator rod 7 is arranged a disk-shaped permanent magnet 8, which is fixed on the actuator rod 7. On the end faces of the permanent magnet 8 are arranged respective flux-conducting plates 9, 10, which strengthen the flux of the permanent magnet. On the outside of these flux-conducting plates 9, 10 are arranged respective anti-adhesion disks 11, 12 or a coating, which prevent sticking to the yokes 5, 6. In addition, on the faces of the permanent magnet 8 and on the armature rod 7, conically-shaped plunger-type armatures 13, 14 are arranged and fixed. The actuator or armature rod 7, the permanent magnet in combination with the flux-conducting plates 9, 10, the anti-adhesion disks 11, 12 and the plunger armatures 13, 14 form the actuating element of the control mechanism or actuator 1. In the drawing the actuating element 15 is shown in its central position, i.e. mid-way between the two coils 3, 4. Coaxially with the permanent magnet 8 and inside the pole tube 2 is arranged an annular holding pole 16, which surrounds the periphery of the permanent magnet 8. As can be seen from the drawing, the annular holding pole 16 has a smaller inside diameter than the pole tube 2, i.e. the holding pole 16 forms a radial construction of the pole tube 2. The permanent magnet 8, together with the flux-conducting plates 9, 10 and the holding pole 16 made from a magnetic material, form a closed magnetic circuit, i.e. the permanent magnet 8 and with it the actuator rod 7 are held by the magnetic forces of the permanent magnet 8 in the position shown. The polarity of the permanent magnet 8 is orientated along the direction of the armature rod 7, i.e. on one side thereof there is a north pole and on the other side thereof a south pole. Radially outside the holding pole 16 is arranged a further coil, a so-termed central coil 17, whose function when energized is to produce a magnetic field which compensates the magnetic field of the permanent magnet 8. This cancels or at least reduces the retaining action due to magnetic closure, so that the actuating element 15 can be displaced more easily and quickly away from its central position to one or the other of its end positions. This improves the dynamic response of the control mechanism 1. The permanent magnet 8 and the actuating element 15 are displaced from the central position shown by energizing one or both coils 3, 4 so that either a force of attraction by one coil, or a force of attraction by one coil and simultaneously a force of repulsion by the other coil act upon the permanent magnet. When the permanent magnet 8 encounters the yoke 5 or 6, the respective plunger armature 13 or 14 enters a corresponding, also conically-shaped opening 5*a* or 6*a* of the yoke 5 or 6. This increases the magnetic attraction or repulsion forces. The anti-adhesion disks 11, 12 prevent the permanent magnet 8 from becoming stuck in either of the two end positions. In the central position shown, the two coils 3, 4 are not energized. Thus, the actuator 1 shown has three stable positions, namely two end positions and a central position, and is therefore tristable. In the two end positions the permanent magnet 8 holds the actuating element 15 fixed against the yoke 5 or 6 and so creates two stable end positions, without need for the coils 3, 4 to be energized.

Figure 2:
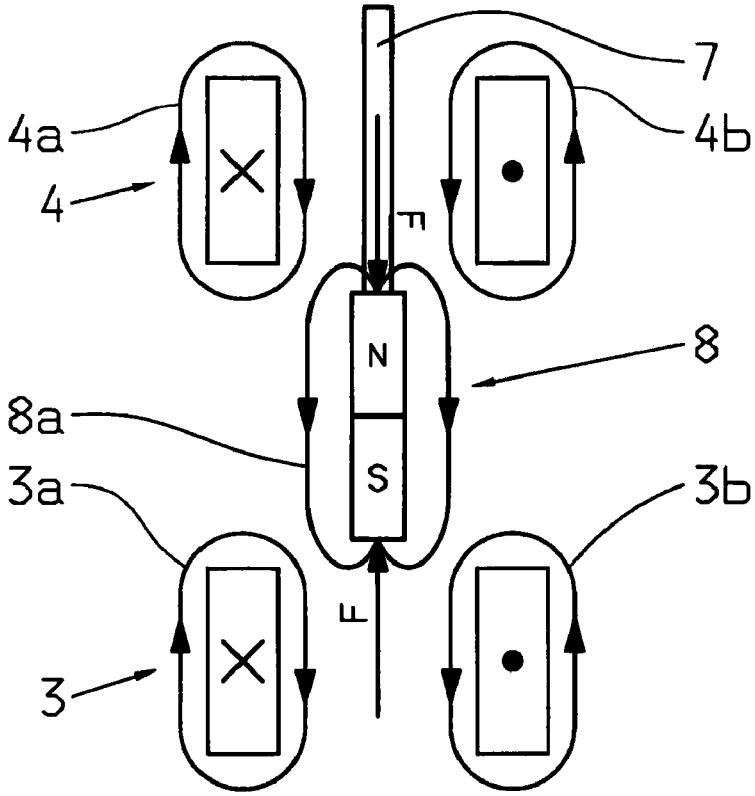
FIG. 2: Schematic representation of the magnetic flux during switching to the central position.

FIG. 2 shows a schematic representation of the magnetic flux of the two coils 3, 4 in FIG. 1 and of the permanent magnet 8 arranged on the armature rod 7. For the coils 3, 4 the magnetic flux and its direction are indicated by oval line-curves 3*a*, 3*b*, 4*a*, 4*b* marked with arrows. The direction of the current flowing in the two coils is indicated by the symbols spot (●) and cross (X). The magnetic flux of the permanent magnet 8, which has a north pole N and a south pole S, is indicated by the line-curve 8*a*. The representation of the currents and magnetic fluxes corresponds to the switching process in which the permanent magnet 8 moves to its central position (as in FIG. 1). As the current flow symbols show, the current flows through both coils 3, 4 in the same direction, i.e. they form identical magnetic fields 3*a*, 3*b*, 4*a*, 4*b*. Thus, the coil 3 forms a south pole on the side facing toward the permanent magnet 8 and the coil 4 forms a north pole on the side facing toward the permanent magnet 8, with the result that forces of repulsion F act in each case on the north pole N and on the south pole S of the permanent magnet 8. Accordingly, the permanent magnet 8 is pushed to its central position between the two coils 3, 4. There—as described earlier—it is held magnetically by the holding pole 16 (see FIG. 1). Once the permanent magnet 8 has reached its stable central position, the coils 3, 4 can be switched off.

Figure 3:
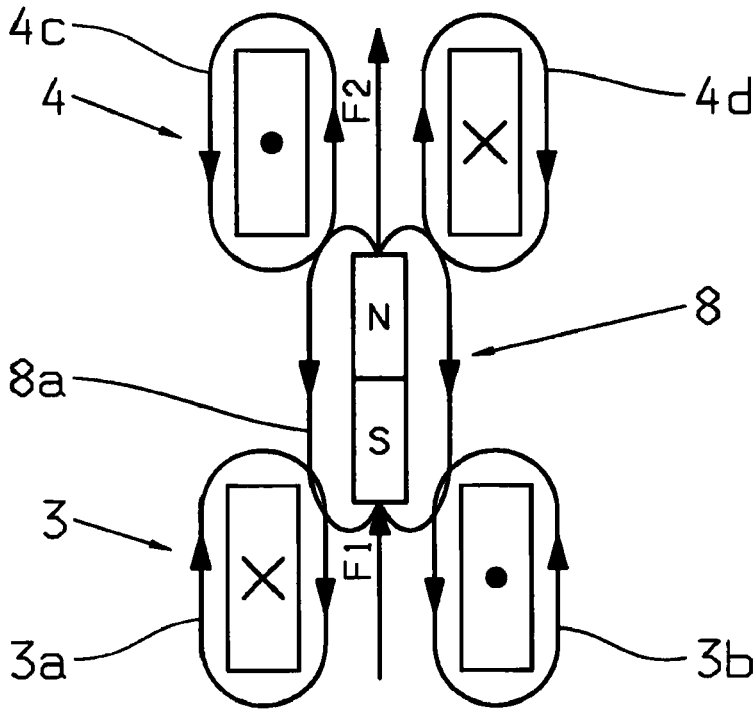
FIG. 3: Schematic representation of the magnetic flux during switching to an end position

FIG. 3 shows a schematic representation of the coils 3, 4 during a switching process in which the permanent magnet 8 and actuating element 15 (see FIG. 1) are moved to an end position. In this switching process current passes through the coils 3, 4 in opposite directions, the lower coil 3 being switched in the same way as the coil 3 in FIG. 2. Thus, its magnetic flux is again indicated by 3*a*, 3*b*. In contrast, the upper coil 4 has a magnetic flux opposite compared with that of FIG. 2, represented by the oval line-curves 4*c*, 4*d*. Consequently south poles are formed in each case on the side of the coils 3, 4 facing toward the permanent magnet 8, with the result that a force of repulsion F1 acts on the south pole S of the permanent magnet 8 and a force of attraction F2 acts on its north pole N. Accordingly, both coils act to displace the actuating element 15 (FIG. 1) in the same direction, giving shorter switching times and improved dynamic response. As mentioned above in connection with FIG. 1, the permanent magnet 8 is then held against the coil yoke 5 by its own permanent magnet forces, so that once the stable end position has been reached the coils 3, 4 can be switched off.

INDEXES

1 Electrodynamic actuator
2 Pole tube
3 Coil
3*a* Magnetic flux
3*b* Magnetic flux
4 Coil
4*a* Magnetic flux
4*b* Magnetic flux
4*c* Magnetic flux
4*d* Magnetic flux
5 Yoke
5*a* Opening
6 Yoke
6*a* Opening
7 Actuator rod
8 Permanent magnet
8*a* Magnetic flux
9 Flux-conducting plate
10 Flux-conducting plate
11 Anti-adhesion disk
12 Anti-adhesion disk
13 Plunger armature
14 Plunger armature
15 Actuating element
16 Holding pole
17 Central coil
N North pole
S South pole F Magnetic force
F1 Repulsion force
F2 Attraction force

The invention claimed is:

1. An electromagnetic control mechanism (1) comprising:

first and second coils (3, 4) each being supported by a respective first and second yokes (5, 6) at axially opposite ends of and within a cylindrical tube (2), each of the first and the second yokes (5, 6) having an opening (5*a*, 6*a*) which is coaxially aligned with and supports an axially slidable actuating element (15), a single permanent magnet (8) being fixed to the actuating element (15) between two flux-conducting plates (9, 10) and two plunger armatures (13, 14), each of the two flux-conducting plates (9, 10) being coupled to and radially extending from a respective one of the two plunger armatures (13, 14) with the permanent magnet (8) being sandwiched therebetween, a holding pole (16) being fixed to and located within the tube (2) between the axially opposite ends thereof, the first and the second yokes (5, 6), the holding pole (16) and the permanent magnet (8) being axially located between and axially separating and spacing the first coil (3) from the second coil (4), the actuating element (15) being axially slidable between a first stable end position, in which the permanent magnet (8) is axially fixed adjacent the first yoke (5), and a second stable end position, in which the permanent magnet (8) is axially fixed adjacent the second yoke (6), depending on variable interaction between a magnetic flux of the permanent magnet (8) and magnetic fields (3*a*, 3*b*, 4*a*, 4*b*) of the first and the second coils (3, 4), and the actuating element (15) being fixable in a third axially centrally located stable position, between the first and the second end positions, by a closed magnetic circuit formed by the permanent magnet (8), the flux-conducting plates (9, 10) and the holding pole (16).

2. The control mechanism according to claim 1, wherein the first and the second coils (3, 4) are arranged in opposite ends of a pole tube (2).

3. The control mechanism according to claim 1, wherein an actuator rod (7) is arranged coaxially within the pole tube (2).

4. The control mechanism according to claim 1, wherein the holding pole (16) is annular and, together with the permanent magnet (8), forms a closed magnetic circuit in the third stable position.

5. The control mechanism according to claim 1, wherein a polarity (N, S) of the permanent magnet (8) is axially orientated.

6. The control mechanism according to claim 1, wherein the two flux-conducting plates (9, 10) are supported by end faces of the permanent magnet (8).

7. The control mechanism according to claim 6, wherein anti-adhesion disks (11, 12) are arranged on the flux-conducting plates (9, 10).

8. The control mechanism according to claim 1, wherein a central coil (17) is arranged in the area of the holding pole (16).

* * * * *